US005894313A

United States Patent [19]

Mabuchi

[11] Patent Number: 5,894,313

[45] Date of Patent: Apr. 13, 1999

[54] INK-JET PRINTING APPARATUS

[75] Inventor: Toshiaki Mabuchi, Tama, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/400,364

[22] Filed: Mar. 8, 1995

[30] Foreign Application Priority Data

Mar. 9, 1994 [JP] Japan ..... 6-038162

[51] Int. Cl.[6] ..... B41J 2/195

[52] U.S. Cl. ..... 347/7; 347/85

[58] Field of Search ..... 347/7, 85, 86, 347/87

[56] References Cited

U.S. PATENT DOCUMENTS

| | | | |
|---|---|---|---|
| 4,178,595 | 12/1979 | Jinnai et al. | 346/140 R |
| 4,202,267 | 5/1980 | Heinzl et al. | 101/364 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,636,814 | 1/1987 | Terasawa | 346/140 R |
| 4,723,129 | 2/1988 | Endo et al. | 346/1.1 |
| 4,740,796 | 4/1988 | Endo et al. | 346/1.1 |
| 4,977,413 | 12/1990 | Yamanaka et al. | 346/140 R |
| 5,132,711 | 7/1992 | Shinada et al. | 346/140 R |
| 5,136,309 | 8/1992 | Iida et al. | 346/140 R |
| 5,414,452 | 5/1995 | Accatino et al. | 347/7 |
| 5,430,469 | 7/1995 | Shioya et al. | 347/15 |
| 5,631,674 | 5/1997 | Shinada et al. | 347/37 |

FOREIGN PATENT DOCUMENTS

| | | | |
|---|---|---|---|
| 0 443 832 A1 | 8/1991 | European Pat. Off. | H04N 1/034 |
| 62-53492 | 3/1987 | Japan . | |
| 3-46589 | 7/1991 | Japan . | |
| 6-015843 | 1/1994 | Japan . | |

*Primary Examiner*—Safet Metjahic
*Assistant Examiner*—John Chizmar
*Attorney, Agent, or Firm*—Fitzpatrick, Cella, Harper & Scinto

[57] ABSTRACT

In an ink remaining amount checking routine to be performed at every one line of printing, when a flag indicative of the ink amount in a sub-tank less than or equal to a predetermined amount, an alarm is generated. Also, while the flag is set, predetermined number of lines capable of printing is performed. Thereafter, ink is supplied. By this, operator may check alarm for ink supply and perform ink supply at a predetermined time interval.

30 Claims, 7 Drawing Sheets

INK-JET PRINTING APPARATUS

BACKGROUND OF THE INVENTION

1. Field of the Invention

The present invention relates generally to a printing apparatus. More specifically, the invention relates to an ink-jet printing apparatus for textile printing performed by ejecting ink toward a cloth.

2. Description of Prior Art

In a printing apparatus employing an ink as printing agent, an ink is generally supplied at the timing where the ink provided at a predetermined amount in the printing apparatus is used out or the remaining amount of the ink becomes small. Supplying of ink is performed by exchanging an ink cartridge storing ink to new one or by supplying the ink to an ink tank to refile it.

In the printing apparatus, such ink supply operation is enabled by stopping printing operation in response to an ink supply command automatically generated by detecting spending out of the ink or manually entered by the operator, for example. However, in typical printing apparatus, even when such ink supply command is detected, on-going printing operation at the detection is continued and printing operation is terminated after completion of printing operation, for the current page, for example, for enabling ink supply. Namely, since the conventional printing apparatus has a margin of remaining amount of ink upon detection of spending out, the foregoing process should not cause any significant problem.

However, when an elongated rolled paper or cloth (a continuous printing medium) is used as printing medium, the amount of image to be continuously printed is relatively large. In such case, even after detection of the ink supply demand, state it is likely to require printing for large amount of image, and the printing operation of non-ink state likely exists and continues for a long time. In such case, it is possible to cause failure in a printing head or so forth. Particularly, in case of so-called bubble-jet printing apparatus employing an ink-jet head assembly, in which the ink-jet head generates bubble in the ink utilizing heat energy and the ink is ejected by generation of the bubble, continuing of printing under the condition where the ink is spent out, may results in damaging of the head.

As a solution for this, it may be considered to terminate printing operation at the timing of spending out of the ink for supplying ink. However, this should make on-going printing incomplete to waste printing medium and ink. Also, in case of large amount printing, the printing period spent becomes wasted to cause degradation of efficiency.

As another solution, for example, an ink reservoir is provided at a location out of motion range of the printing head and so forth in printing operation, and is connected to the printing head by means of movable tube or so forth. With such arrangement, when shorting of ink is detected by a ink remaining amount sensor, the operator may supply new ink to the ink reservoir so that printing operation can be continued without interruption and without causing possibility of damaging of the head.

However, even in this case, upon shorting of ink, for instance, at the occurrence of alarm signal of the ink remaining amount sensor upon detection of shorting of ink, ink supply operation per se is inherent. Also, since the printing operation will never stop, when continuous printing is to be performed for long period, the operator should monitor shorting of the ink throughout the printing period so that the ink can be instantly supplied at the occurrence of shorting of the ink.

SUMMARY OF THE INVENTION

An object of the present invention is to provide a printing apparatus permitting large volume of continuous printing with a printing sequence taking ink supply into account.

Another object of the invention is to provide a printing apparatus which can generate alarm when an ink amount in a container becomes less than or equal to a given amount, continue given amount of printing operation, and subsequently interrupt printing operation.

In a first aspect of the present invention, there is provided a printing apparatus using a printing head ejecting an ink for performing printing by ejecting the ink on to a printing medium, comprising:

- a container for maintaining the ink to be supply to the printing head;
- detecting means for detecting remaining amount condition of the ink within the container;
- alarming means for generating an alarm when an ink amount detected by the detecting means becomes less than or equal to a given amount;
- remaining amount printing means for continuing printing operation for a predetermined amount after generation of the alarm; and
- temporary interruption means for interrupting printing operation after the predetermined amount of the printing operation is continued.

In a second aspect of the present invention, there is provided an ink-jet printing apparatus using a printing head for ejecting an ink and, a container maintaining the ink to be supplied to the printing head, and performing printing by ejecting ink toward a printing medium, the apparatus comprising:

- alarming means for generating an alarm indicative that an amount of the ink in the container during printing operation using the printing head;
- stopping means for performing a predetermined amount of a printing operation while the alarm is generated and for stopping the printing operation after the predetermined amount of the printing operation;
- printing operation resuming means for resuming operation when the ink is supplied under interrupting state.

In a third aspect of the present invention, there is provided a printing method for performing printing by ejecting ink to a printing medium, comprising the steps of:

- preparing a printing head for ejecting an ink and a container for storing ink to be supplied to the printing head;
- performing alarming indicative that an ink amount within the container is less than or equal to a given amount during printing operation using the printing head;
- performing a predetermined amount of printing operation and stopping printing operation after performing a predetermined amount of printing operation while the alarm is continued; and
- resuming the printing operation when the ink is supplied to the container in a stopped state.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

Preferred embodiments of the present invention will be discussed herein after in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
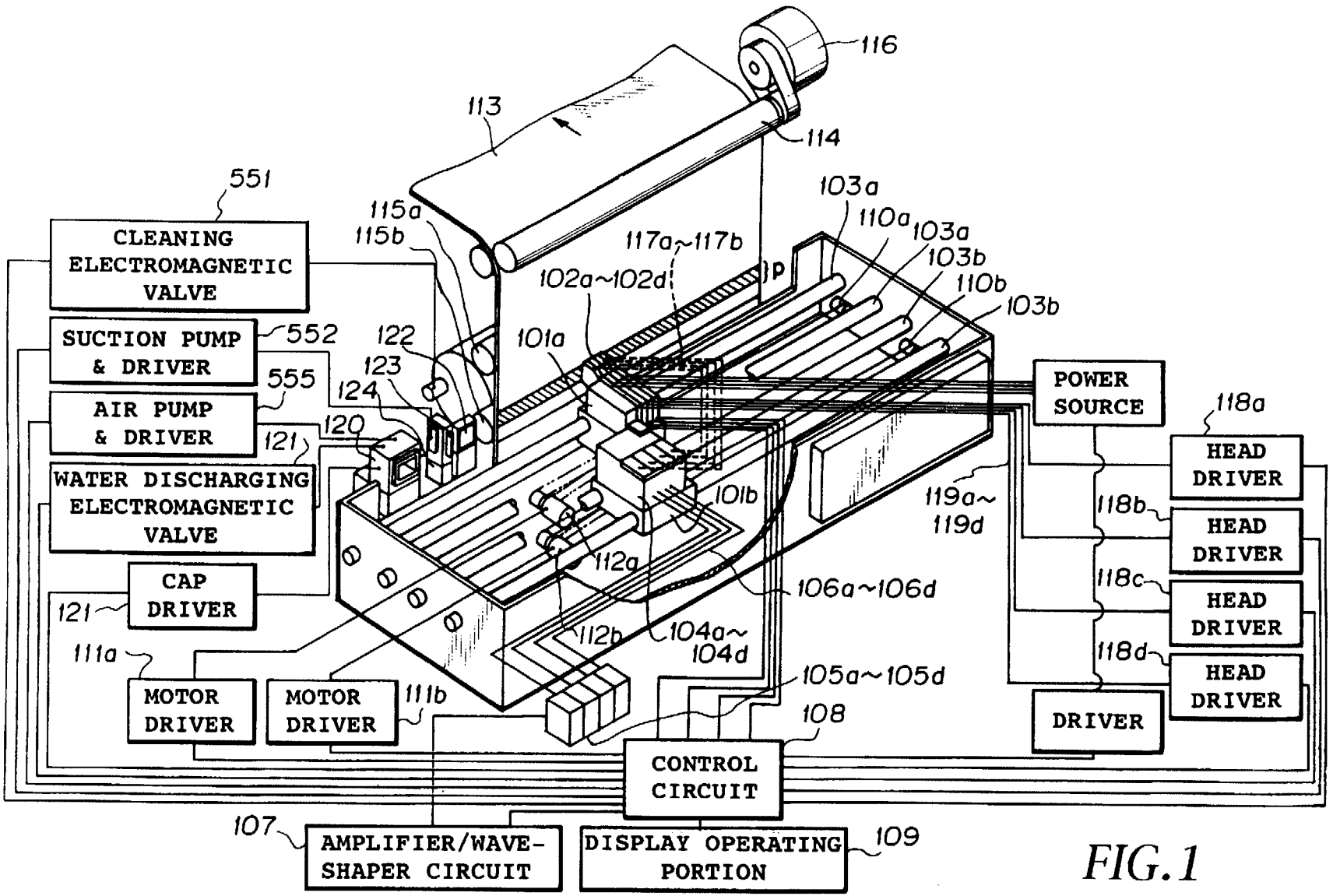
FIG. 1 is a block diagram showing an ink-jet textile printing system as one embodiment of an apparatus applied the present invention.
Figure 2:
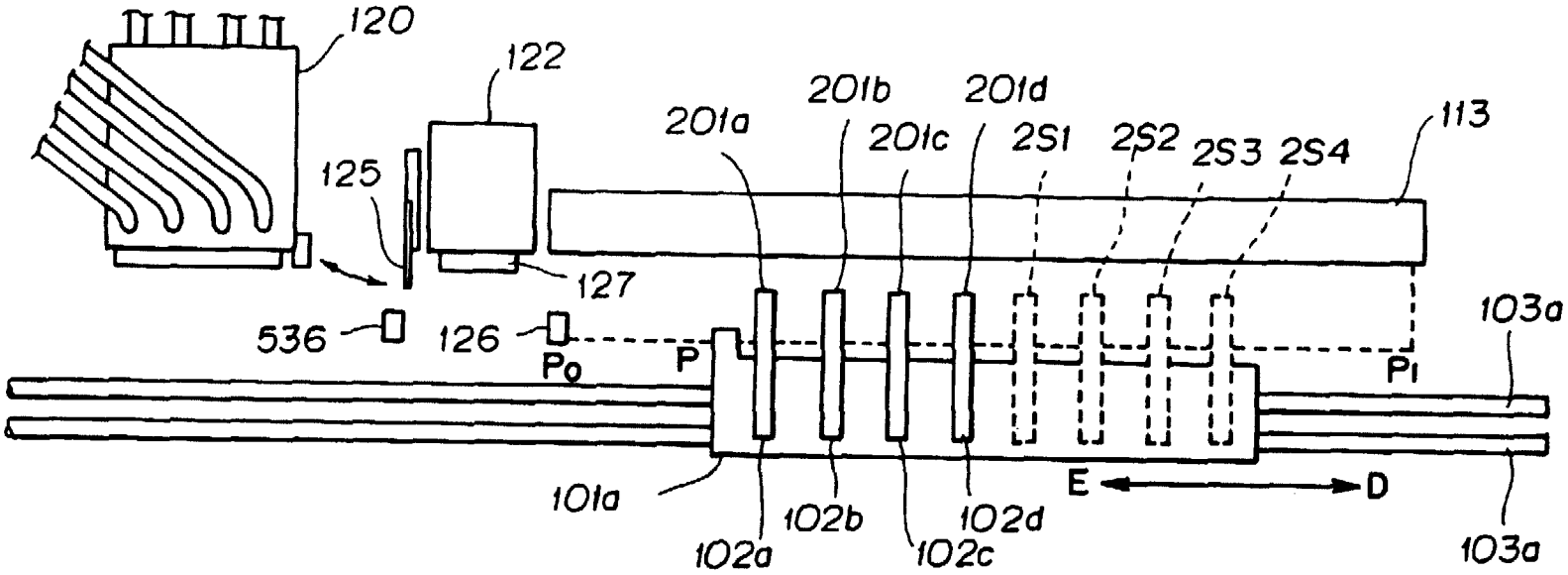
FIG. 2 is a diagrammatic top plan view showing a construction in the vicinity of a home position in the apparatus of FIG. 1.

FIG. 1 is a block diagram illustrating one embodiment of a textile printing system according to the present invention, and FIG. 2 is a top plane view showing detail of a printing portion for explaining printing operation in the system of FIG. 1.

In FIGS. 1 and 2, a carriage 101*a* carries respective printing heads 102*a* to 102*d* for color printing corresponding cyan, magenta, yellow and black. Two guide shafts 103*a* movably guide and support the carriage 101*a*. On the other hand, a carriage 101*b* carries ink sub-tanks 104*a* to 104*d* storing respective of four color inks of cyan, magenta, yellow and black. Similarly, two guide shafts 103*b* movably guide and support the carriage 101*b*. Ink supply for the printing heads 102*a* to 102*d* is performed from respectively corresponding ink sub-tanks 104 to 104*d* through supply tubes 117*a* to 117*d*.

For energy generation means (not shown) to be utilized for ejecting ink in each of the printing heads 102*a* to 102*d*, ink ejection signals are selectively supplied from respective printing head driver 118*a* to 118*d* via flexible cables 119*a* to 119*d*.

The ink sub-tanks 104*a* to 104*d* are connected to ink main tanks 105*a* to 105*d* fixed outside of a printer main body via flexible tubes 106*a* to 106*d*.

Within the ink main tanks 105*a* to 105*d*, sensors (not shown) for monitoring remaining amount of inks are arranged. Outputs of the sensors are converted into logical level via appropriate amplifier/wave-shaper circuit 107 and then input to a control circuit 108.

Belts 110*a* and 110*b* constituted of endless belts are connected to the head carriage 101*a* and the ink carriage 101*b* at one portion. By this, to the carriages 101*a* and 101*b*, driving forces of driving of the motors 112*a* and 112*b* are transmitted, respectively. The driving of the motors 112*a* and 112*b* as pulse motors are controlled through motor drivers 111*a* and 111*b*. With the construction set forth above, the carriages 101*a* and 101*b* become possible to move along a printing surface of a printing medium 113, such as cloth paper, OHP film and so forth as guided by the guide shafts 103*a* and 103*b*. Also, the shown textile printing system includes a transporting roller 114 for transporting the printing medium 113, guide rollers 115*a* and 115*b* for guiding the printing medium and a printing medium transporting motor 116.

A capping unit 120 is adapted to sealingly contact with ejection orifice plane of the printing heads 102*a* to 102*d* in non-printing state. Namely, during non-printing state, the printing heads 102*a* to 102*d* are moved to the position opposing to the capping unit 120. At this time, the capping unit 120 is driven forward by a cap driver 121 to depress its elastic member onto the ejection opening plane to establish capping.

The capping unit 120 is provided for covering (capping) the ejection portion primarily for preventing evaporation of ink to cause increasing of viscosity resulting in instability of ejection when the printing heads are held not used for a long period. Within the cap, a hygroscopic material wetted by ink is provided for maintaining interior space of the cap at high humidity to minimize increasing of viscosity of the ink.

Also, after maintaining in capped state for a long period, recovery is performed by pressurizing the ink. Namely, when the printing head is left unused for a long period, a little amount of the ink within the ejection orifice evaporates to increase viscosity, even though cap is applied. It is also possible that fine residual bubble within the ejection orifice grows during long period left not used, to prevent the ink from being ejected stably. Therefore, upon initiation of ink, a pump provided with the ink tank is driven to pressurize the ink to discharge the high viscous ink and residual bubble. Such recovery action is further effective for washing out dust or dirt adhering on the ejection orifice plane or penetrating into the ejection orifice.

A blocking prevention unit 122 is adapted to receive the ejected ink during preliminary ejection of the printing heads 102*a* to 102*d*. The blocking prevention unit 122 may be opposed to the printing heads 102*a* to 102*d* by shifting the latter. The blocking prevention unit 122 has a liquid receptacle member serving as liquid receiving portion for accommodating the ejected ink in the preliminary ejection. The blocking prevention unit 122 is arranged at a position between the capping unit 120 and a printing start position. It should be noted that, as a material for the liquid receptacle member and a liquid holding member, sponge-like porous material, plastic sintered body and so forth are effective.

It should be appreciated that the above-mentioned preliminary ejection is the ejection of ink not for printing but for increasing temperature of the printing head to a predetermined value, and for removable of foreign matters within the ejection opening. Also, in addition to this, before initiation of printing, given drive pulse is applied for ink ejection through all of the ejection orifice toward the cap portion or so forth (aging operation). Also, for increasing wet condition in the environment around the ejection orifice, it is possible to perform preliminary ejection with applying the cap. There may be occurred in depending upon an image data for printing that the ink is ejected form one orifice and is not ejected form another orifice among the respective orifices of the print head. Therefore, in an orifice from which the ink is not ejected for a long time, viscosity of ink may be increased. The above-described preliminary ejection can also resolve this state.

A cleaning unit 124 is connected to a cleaning electromagnetic valve 551 and a suction pump driver 552. The cleaning electromagnetic valve 551 actuates ejection of cleaning liquid from a wiping cleaning means 123 and an absorption of the cleaning liquid by the cleaning unit 124 under the control of the control circuit 108.

Figure 3:
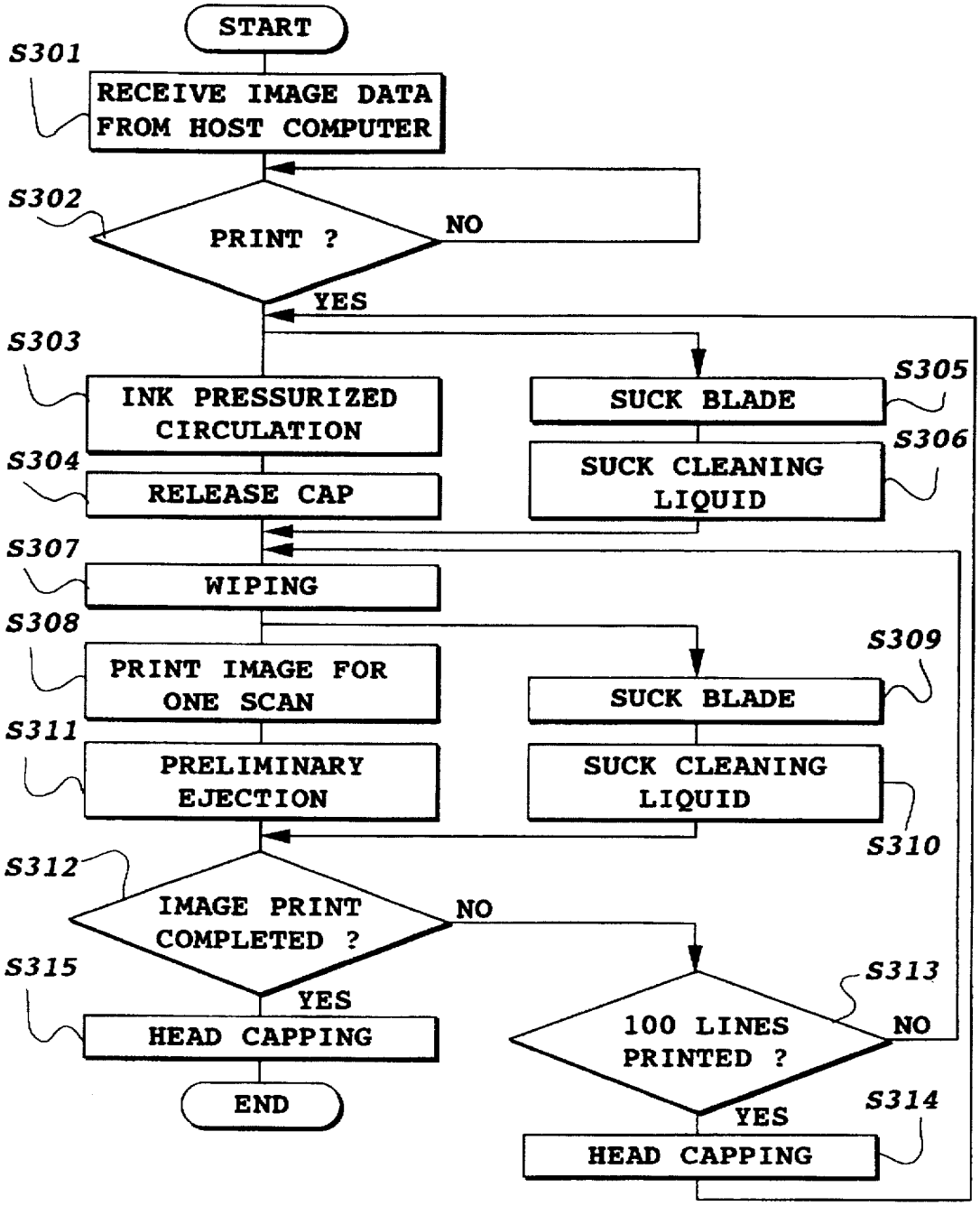
FIG. 3 is a flowchart showing one example of a printing sequence as a premise for the embodiment applied the present invention.

FIG. 3 is a flowchart showing a printing operation sequence as a premise of the present invention employing the construction set forth above.

At first, during stand-by state, the ejection orifice surfaces 201*a* to 201*d* (see FIG. 2) of the printing heads 102*a* to 102*d* are held in capped state by the capping unit 120.

In the shown sequence, at first, at a step S301, an image data and control data including command for designating attribute, such as, hardware magnification rate, printing length and so forth, are transmitted from a host computer, the apparatus is placed in a stand-by state waiting for input of a print start signal via an input means on a display operating portion 109 (step S302).

When the print start signal is input, after pressurized circulation of ink (step S303), the cap is released (step S304). In conjunction therewith, cleaning of the cleaning member 125 (see FIG. 2) is also performed (step S305) so as to wash out high viscous ink and foreign matters adhering on the cleaning member 125 with a cleaning liquid. Also, at a step S306, suction of the cleaning liquid is performed. By this, the residual cleaning liquid amount in the cleaning member 125 can be appropriately reduced to enhance ink and foreign matter collecting ability to improve cleaning effect by the cleaning member 125. Furthermore, by sucking the cleaning liquid, a negative pressure to be generated by capillary phenomenon of the porous body forming the cleaning member 125, can be maintained at effective level. By adjusting this negative pressure to be greater than the negative pressure in the ejection orifice of the printing head, the ink can be drawn from the ejection orifice during cleaning operation and penetration of the cleaning liquid can be successfully prevented. Furthermore, since the negative pressure may provide capability of sucking the ink within the ejection orifice, the viscous ink within the ejection orifice can be removed in cleaning.

Next, by feeding drive signals to the driving motors 112*a* and 112*b* via the motor drivers 111*a* and 111*b*, the carriages 101*a* and 101*b* are driven. Thus, the printing heads 102*a* to 102*d* and the ink sub-tanks 104*a* to 104*d* are reciprocally driven along the guide shafts 103*a* and 103*b*. At this time when the carriage 101*a* passes on the front of the cleaning unit 124, the cleaning member 125 sequentially sweeps of the ejection orifice surfaces 201*a* to 201*d* to perform cleaning (step S307). It should be noted that, in the shown embodiment, sweep means removal of cleaning liquid, ink, foreign matters and so forth from the ejection plane.

Thereafter, ink droplet is ejected from the printing head while traveling in the direction shown by an arrow D (see FIG. 2) from a print start detecting position P0 detected by a print start detection sensor 126. Thus, image printing on the printing width portion P of the printing medium 113 is performed (step S308). At the same time, cleaning of the cleaning member is performed (step S309). Next, the cleaning liquid is sucked (step S310) for recovering cleaning performance of the cleaning member.

Subsequently, the carriages 101*a* and 101*b* are reversed to be driven in the direction of an arrow E (see FIG. 2). When the carriage passes on the position at which the print head is opposed to the blocking prevention unit 122, the preliminary ejection is performed (step S311). Here, the preliminary ejection is performed toward the liquid receptacle member 127 in the blocking prevention unit 122 (see FIG. 2). Then, the printing medium 113 is fed in a direction perpendicular to the paper plane of FIG. 2 in the extent corresponding to the width of the printing portion P.

Next, when the image printing is continued (when the answer at a step S312 is negative), and if 100 line printing is not yet completed (when the answer at a step S313 is negative), the process is returned to the step S307 to repeat the foregoing printing operation.

On the other hand, when the 100 line printing of the image data is completed (when the answer at the step S313 is positive), the ejection plane 201*a* to 201*d* of the printing heads 102*a* to 102*d* are capped by the capping unit 120 (step S314). Then, process is returned to steps S303/S305 to perform ink pressured circulation. Thereafter, the printing operation is continued. This is because that when printing is performed for about 100 lines, fluctuation of ejection frequencies at respective ejection orifices of the printing heads 102*a* to 102*d* becomes significant. Namely, in certain ejection opening, only a few occurrence of ink ejection is performed to cause increasing of viscosity within the ejection opening. Also, it is possible that a large amount of residual bubble is caused. Namely, in order to remove such viscous ink and bubble, pressurized circulation is performed.

When judgment is made that image printing is completed (when the answer at the step S312 is positive), the ejection orifice surfaces 201*a* to 201*d* of the printing heads 102*a* to 102*d* are capped by the capping unit 120. After capping by the capping unit 120 (step S315), the printing operation is terminated.

Several embodiments where the present invention is applied to the foregoing printing sequence will be discussed hereinafter with reference to FIGS. 4 to 7.

(First Embodiment)

Figure 4:
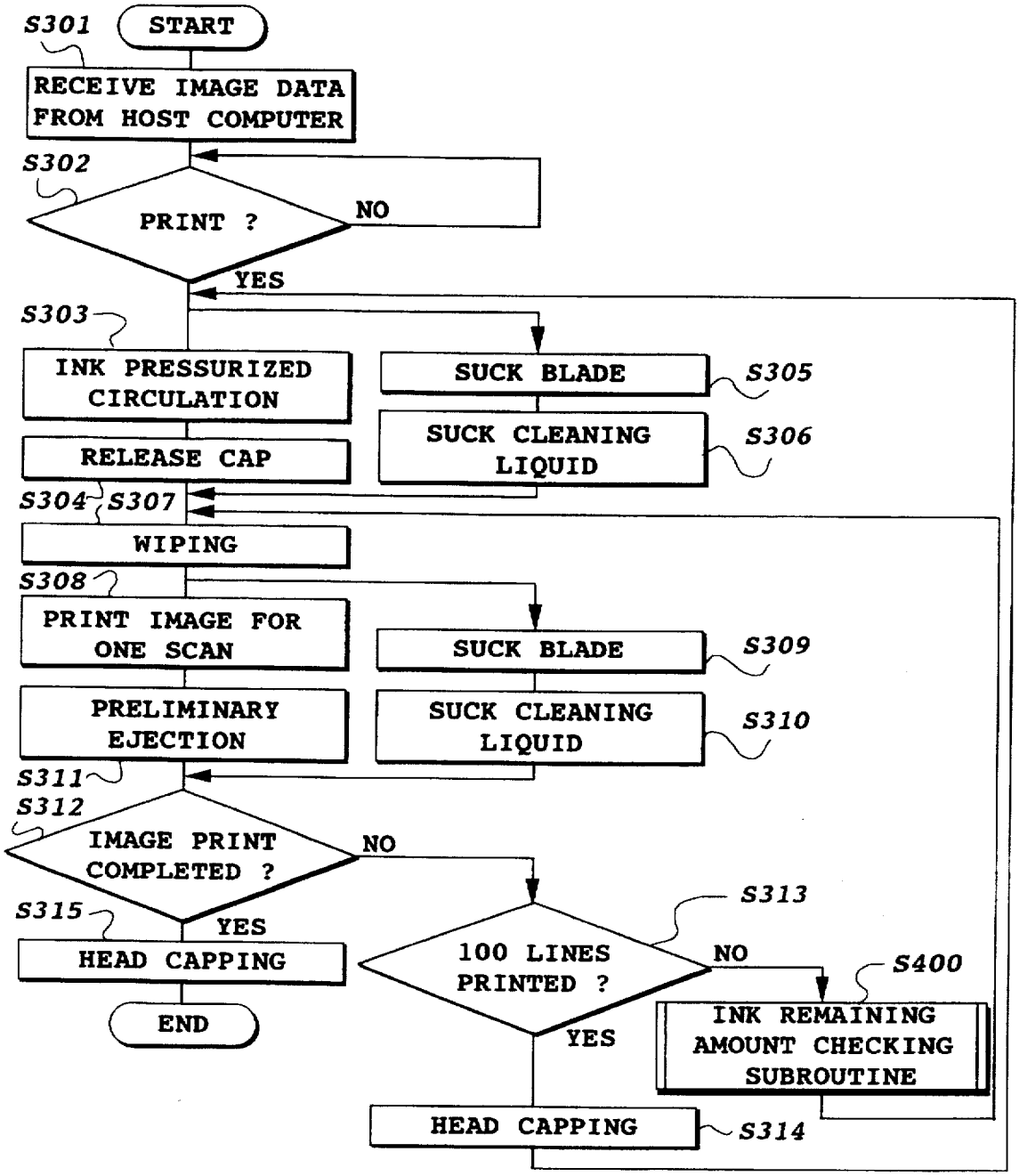
FIG. 4 is a flowchart showing a printing sequence in the embodiment of the invention.

FIG. 4 is a flowchart showing a printing operation sequence in the first embodiment of the present invention. In FIG. 4, the common processes to the processes of FIG. 3 will be represented by the same step numbers, and detailed discussion thereof will be neglected.

In the first embodiment of the invention, when the answer at the step S313 is negative (namely, the printing operation is continued without performing ink pressurized circulation), call is made to an ink remaining amount checking subroutine (step S400). It should be noted that this sub-routine call step is present at a timing immediately after the step 313 in the example of FIG. 4. It is also possible to perform the step in the print sequence loop (namely, can be placed at any arbitrary position in the steps of S303 to S311, shown in FIG. 3. Furthermore, it is possible to perform the process of the subroutine by interrupt process by a timer.

Figure 5:
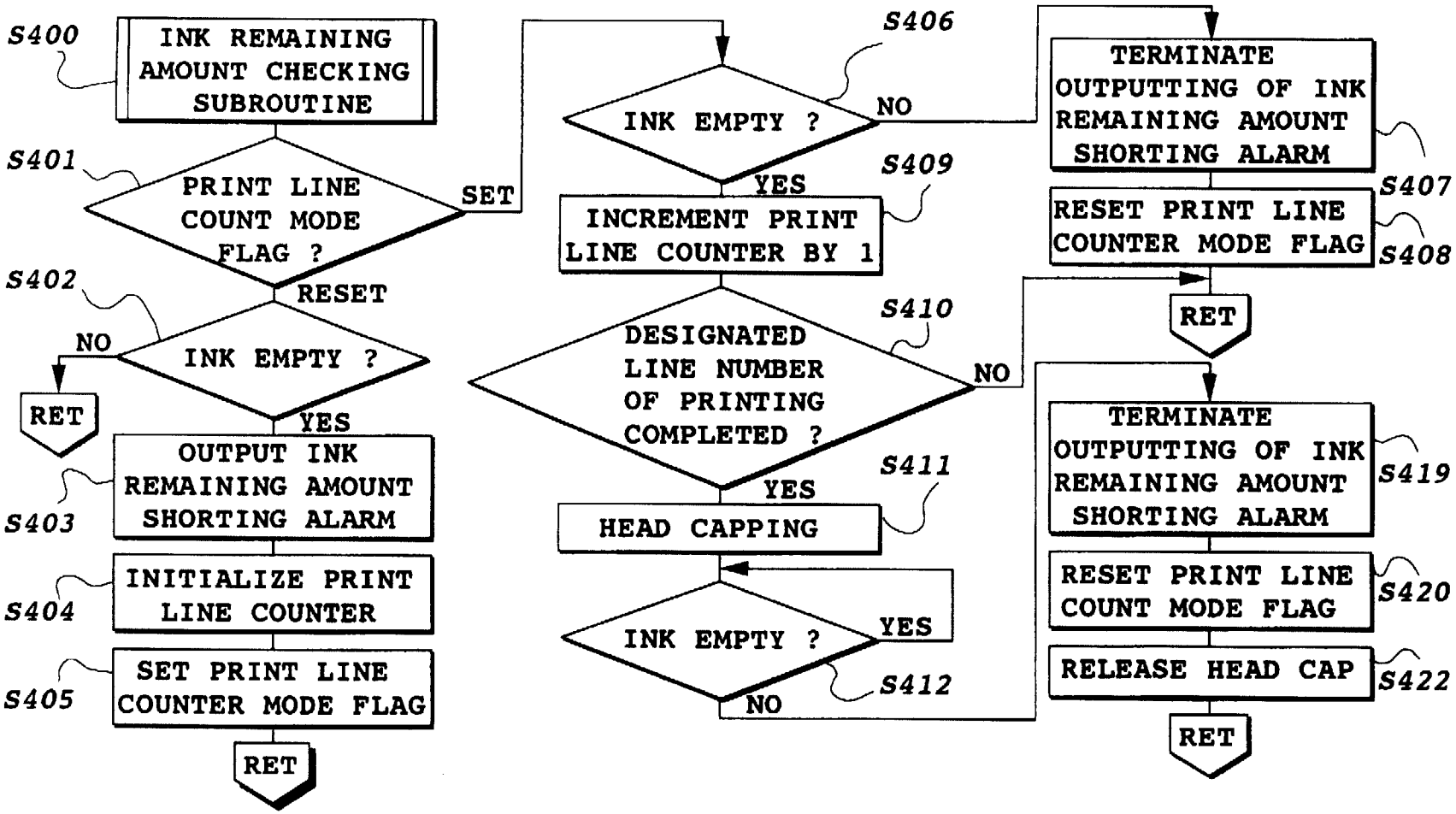
FIG. 5 is a flowchart showing an ink remaining amount checking subroutine in a first embodiment of the invention.

FIG. 5 shows a flowchart showing the detailed operation sequence of the above-mentioned remaining amount checking subroutine.

In FIG. 5, at a step S401, a print line count mode flag (discussed later) is checked. When the flag is in reset state, the process is advanced to a step S402. At the step S402, judgment is made with respect to the signals output from the remaining amount detection sensors in the ink main tanks 105*a* to 105*d*. If all sensor outputs indicate presence of inks, namely the answer at the step S402 is negative, execution of the subroutine is terminated to return to the sequence of FIG. 4. In the normal state where inks are present, this procedure is executed.

When the answer at the step S402 is positive, an ink remaining amount shorting alarm, for example, go on and off of light corresponding to the ink color is output or the display operating portion 109 (see FIG. 1) (step S403). At the same time, the print line counter is initialized to prepare for counting of printing line numbers (step S404). Then, a flag (print line count mode flag) indicative of the mode where remaining amount of ink becomes small and printing operation is continued with outputting alarm, is set (step S405). Thereafter, the shown subroutine is terminated.

When the print line count mode flag is set as checked at the step S401, the outputs from the remaining amount sensors in the ink main tanks 105*a* to 105*d* are checked at a step S406 for checking if the ink is supplied or not. If the answer at the step 406 is negative, namely the remaining ink amount is not small, judgment can be made that the ink is supplied. Therefore, outputting of the ink remaining amount shorting alarm is terminated (step S407). Thereafter, the flag (print line count mode flag) indicative of the mode where remaining amount of ink becomes small and printing operation is continued with outputting alarm, is reset (step S408). Thereafter, the execution of the subroutine is terminated. The above-described procedure is performed in the case that to the ink main tanks 105*a* to 105*d* disposed out of the moving region of the carriages, ink is supplied by the operator and ink amount of the tanks 105*a* to 105*d* is increased while the alarm is output.

When the answer at the step S406 is positive, it is quite possible that the ink is not yet supplied and printing is continued, outputting of alarm is continued and the print line counter indicative of the how many lines are printed after initiation alarming is incremented by "1" (step S409). Then, the counter value of the print line counter is checked against a predetermined line number (step S410). The predetermined line number is determined as line number (including margin) to expire the ink in the ink main tank when printing is performed at 100% duty at every printing line.

When the answer at the step S410 is negative, it is judged that the ink for printing is remained. Therefore, the process in the subroutine is terminated and printing operation is continued.

When the answer at the step S410 becomes positive, it is possible that ink is shorting to cause ejection failure or possibly damage the head, the printing operation is temporarily interrupted. Then, the head is moved to the position opposing to the cap for capping (step S411). Subsequently, at a step S412, the signal output from the ink remaining amount detection sensors within the ink main tanks 105*a* to 105*d* is checked in the stand-by state. The stand-by state is maintained until ink is supplied.

When supplying of ink is detected based on the output of the ink remaining amount detecting sensor, the process is advanced to a step S419 to terminate outputting of the ink remaining amount shorting alarm.

Thereafter, the print line count mode flag is reset (step S420), the head cap is released (step S422) and then, the subroutine is terminated to resume printing operation.

(Second Embodiment)

As set forth, in the first embodiment, when the ink is supplied while the printer is in temporarily interrupted mode, the printing sequence is resumed (steps S412 to S422 shown in FIG. 5). Namely, when judgment is made that the ink is supplied, the process exits from the ink remaining amount check subroutine to resume printing operation through the step S307 and subsequent steps. Associating with initiation of this operation, it is not clear what the timing, the carriage starts to move. Therefore, since the printer is not active for executing the ink remaining amount check surface, the operator performs certain operation overlooking the fact that the printer is in temporarily interrupted mode, the carriage may suddenly start operation at the mid-way of on-going operation performed by the operator. In such case, problem may be arisen on the operator and/or the apparatus. Especially, in case of the textile printing apparatus applied the present invention, since the carriage is relatively large, such sudden motion of the carriage may injure the operator.

Therefore, in the shown embodiment, for solving the problem set forth above, a procedure illustrated in FIG. 6, in which the later-mentioned process is added for the procedure in FIG. 5, is employed.

Figure 6:
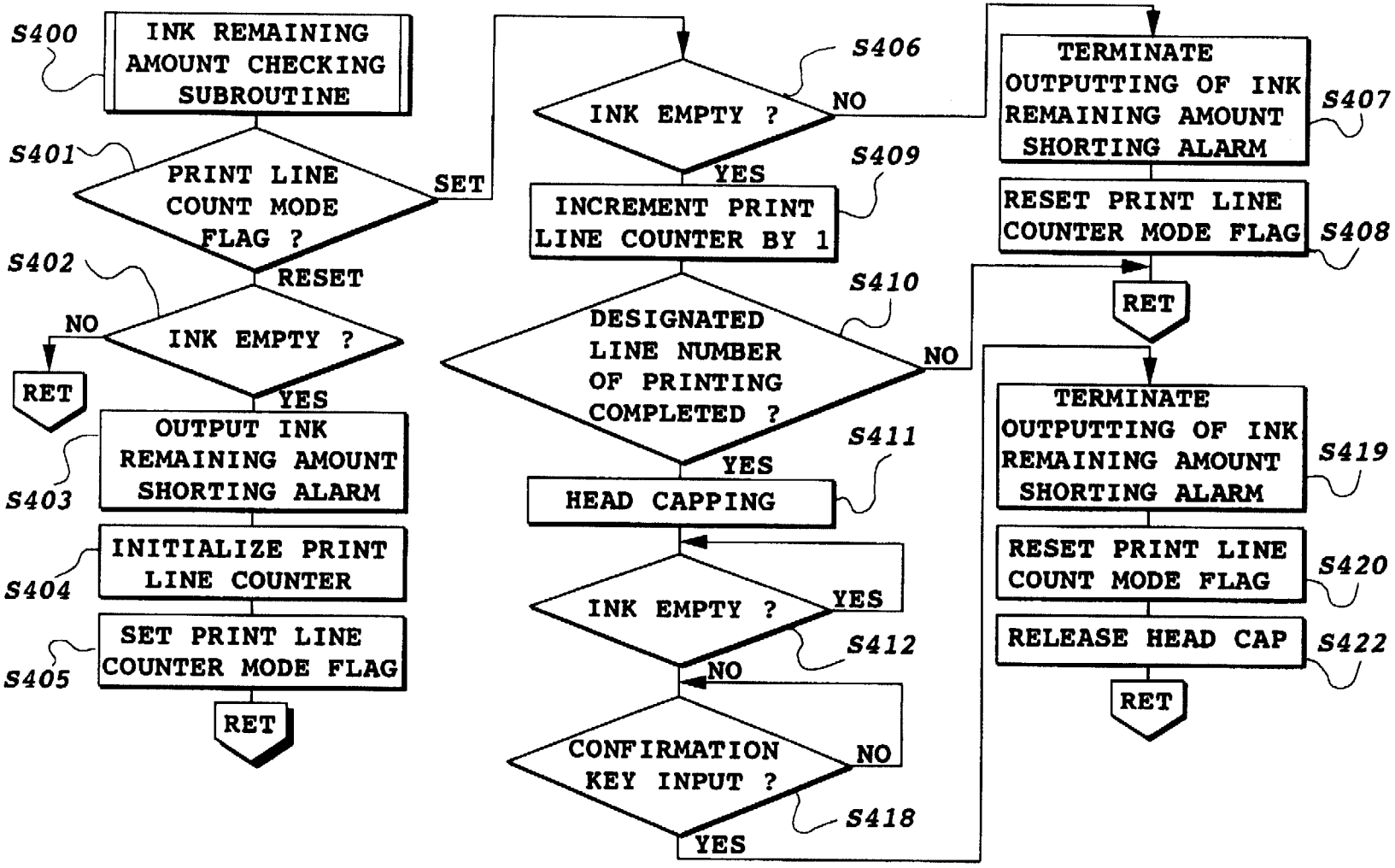
FIG. 6 is a flowchart showing an ink remaining amount checking subroutine in a second embodiment of the invention.

In the procedure illustrated in FIG. 6, when supply of ink is detected in the judgment at the step S412 (when the answer at the step S412 becomes negative), the process is advanced to a step S418.

At the step S418, a predetermined input through a predetermined confirmation key on the display operating portion 109 is monitored. When the predetermined key input is present, the process is advanced to the step S419. By adding such step, the operation sequence can be resumed only when the confirmation key input is made by the operator. Therefore, the above-mentioned problem can be successfully solved. Namely, unless the operator realizes the status that the ink remaining amount checking subroutine is in active state and the confirmation key is operated only after confirmation that the ink is re-filled, problem will never be arisen by unexpected operation of the carriage.

(Third Embodiment)

In the foregoing first and second embodiments, it is possible that ink supply by the operator is not performed for the long period and it takes long period to make judgment that the ink is filled at the step S412, while the printing head is capped and the printing operation is in temporarily interrupted state by execution of the ink remaining amount checking subroutine. In such case, as set forth above, it is possible that stable ink ejection cannot be performed for increased viscosity or generation of bubble in the ejection opening.

Figure 7:
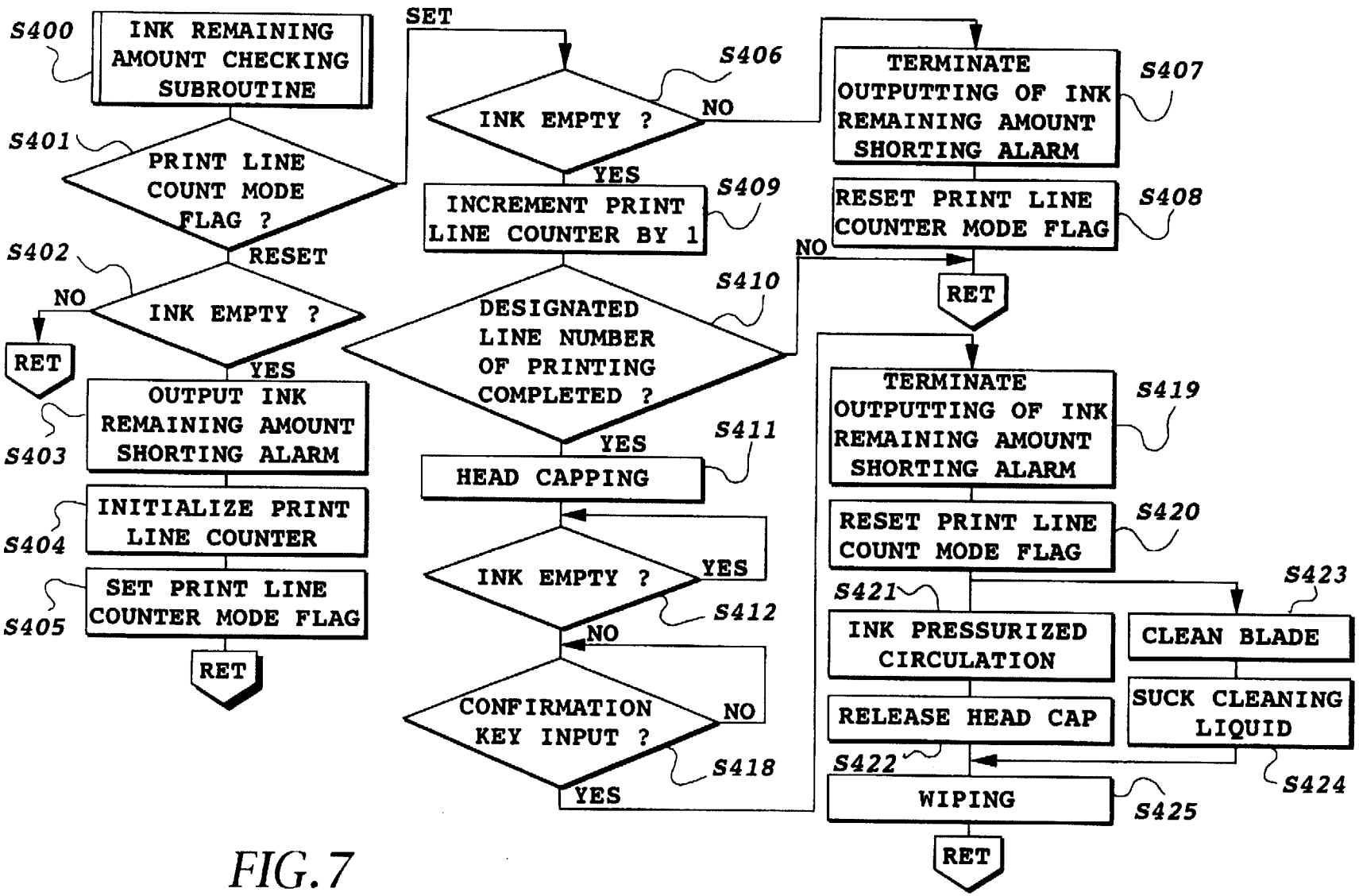
FIG. 7 is a flowchart showing an ink remaining amount checking subroutine in a third embodiment of the invention.

Therefore, as shown in FIG. 7, immediately before resumption to the printing sequence, ink pressurized circulation (step S421), head cap releasing (step S422), blade cleaning (step S423), suction of cleaning liquid (step S424), wiping (step S425) are performed in advance of resumption of the printing sequence. By this, more stable ejection can be performed.

It should be noted that as the remaining amount detection sensor shown in respective embodiment, a sensor disposing a float within the ink tank and the position of the float is optically detected or a sensor got detecting resistance value between electrodes to detect whether the ink remaining amount is greater than or equal to the predetermined value.

Subsequently, the description will be made of the entire processes of the ink jet textile printing. After the ink jet textile printing process is executed by the use of the above-mentioned ink jet printing apparatus, the textile is dried (including the natural dry). Then, in continuation, the dyestuff on textile fabric is dispersed, and a process is executed to cause the dyestuff to be reactively fixed to the fabric. With this process, it is possible for the printed textile to obtain a sufficient coloring capability and strength because of the dyestuff fixation.

For this dispersion and reactive fixation processes, the conventionally known method can be employed. A steaming method is named, for example. Here, in this case, it may be possible to give an alkali treatment to the textile in advance before the textile printing.

Then, in the post-treatment process, the removal of the non-reactive dyestuff and that of the substances used in the preparatory process are executed. Lastly, the defect correction, ironing finish, and other adjustment and finish processes are conducted to complete the textile printing.

Particularly, the following performatory characteristics are required for the textile suitable for the ink jet textile printing:

(1) Colors should come out on ink in a sufficient density.

(2) Dye fixation factor is high for ink.

(3) Ink must be dried quickly.

(4) The generation of irregular ink spread is limited.

(5) Feeding can be conducted in an excellent condition in an apparatus.

In order to satisfy these requirements, it may be possible to give a preparatory treatment to the textile used for printing as required. In this respect, the textile having an in receptacle layer is disclosed in Japanese Patent Application Laying-open No. 62-53492, for example. Also, in Japanese Patent Application Publication No. 3-46589, there are proposed the textile which contains reduction preventive agents or alkaline substances. As an example of such preparatory treatment as this, it is also possible to name a process to allow the textile to contain a substance selected from an alkaline substance, water soluble polymer, synthetic polymer, water soluble metallic salt, or urea and thiourea.

As an alkaline substance, there can be named, for example, hydroxide alkali metals such as sodium hydroxide, potassium hydroxide; mono-, di-, and tori-ethanol amine, and other amines; and carbonate or hydrogen carbonate alkali metallic salt such as sodium carbonate, potassium carbonate, and sodium hydrogen carbonate. Furthermore, there are organic acid metallic salt such as calcium carbonate, barium carbonate or ammonia and ammonia compounds. Also, there can be used the sodium trichloroacetic acid and the like which become an alkaline substance by steaming and hot air treatment. For the alkaline substance which is particularly suitable for the purpose, there are the sodium carbonate and sodium hydrogen carbonate which are used for dye coloring of the reactive dyestuffs.

As a water soluble polymer, there can be named starchy substances such as corn and wheat; cellulose substances such as carboxyl methyl cellulose, methyl cellulose, hydroxy ethel cellulose; polysaccharide such as sodium alginic acid, gum arabic, locasweet bean gum, tragacanth gum, guar gum, and tamarind seed; protein substances such as gelatin and casein; and natural water soluble polymer such as tannin and lignin.

Also, as a synthetic polymer, there can be named, for example, polyvinyl alcoholic compounds, polyethylene oxide compounds, acrylic acid water soluble polymer, maleic anhydride water soluble polymer, and the like. Among them, polysaccharide polymer and cellulose polymer should be preferable.

As a water soluble metallic salt, there can be named the pH4 to 10 compounds which produce typical ionic crystals, namely, halogenoid compounds of alkaline metals or alkaline earth metals, for example. As a typical example of these compounds, NaCl, $Na_2SO_4$, KCl and $CH_3$ COONa and the like can be named for the alkaline metals, for example. Also, $CaCl_2$, $MgCl_2$, and the like can be named for the alkaline earth metals. Particularly, salt such as Na, K and Ca should be preferable.

In the preparatory process, a method is not necessarily confined in order to enable the above-mentioned substances and others to be contained in the textile. Usually, however, a dipping method, padding method, coating method, spraying method, and others can be used.

Moreover, since the printing ink used for the ink jet textile printing merely remains to adhere to the textile when printed, it is preferable to perform a subsequent reactive fixation process (dye fixation process) for the dyestuff to be fixed on the textile. A reactive fixation process such as this can be a method publicly known in the art. There can be named a steaming method, HT steaming method, and thermofixing method, for example. Also, alkaline pad steaming method, alkaline blotch steaming method, alkaline shock method, alkaline cold fixing method, and the like can be named when a textile is used without any alkaline treatment given in advance.

Further, the removal of the non-reactive dyestuff and the substances used in the preparatory process can be conducted by a rinsing method which is publicly known subsequent to the above-mentioned reactive fixation process. In this respect, it is preferable to conduct a conventional fixing treatment together when this rinsing is conducted.

In this respect, the printed textile is cut in desired sizes after the execution of the above-mentioned post process. Then, to the cut off pieces, the final process such as stitching, adhesion, and deposition is executed for the provision of the finished products. Hence, one-pieces, dresses, neckties, swimsuits, aprons, scarves, and the like, and bed covers, sofa covers, handkerchiefs, curtains, book covers, room shoes, tapestries, table clothes, and the like are obtained. As the methods of machine stitch to make clothes and other daily needs, a widely known method can be used.

As described above, according to the present invention, it is possible to obtain a high cleaning effect of the liquid discharging surface of the liquid discharging head as well as a long-time stability of the liquid discharging.

Thus, it is possible to produce the effect that the stable recovery can be executed even in a case where a highly viscous liquid is used or highly densified nozzles are employed, or further, an industrial use is required for a long time under severe conditions.

The present invention produces an excellent effect on an ink jet printing head and printing apparatus, particularly on those employing a method for utilizing thermal energy to form flying in droplets for the printing.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type printing system and a continuous type printing system. Particularly, however, it is suitable of the on-demand type because the principle is such that at least one driving signal, which provides a rapid temperature rise beyond a departure from nucleation boiling point in response to printing information, is applied to an electrothermal transducer disposed on a liquid (ink) retaining sheet or liquid passage whereby to cause the electrothermal transducer to generate thermal energy to produce film boiling on the thermoactive portion of the printing head; thus effectively leading to the resultant formation of a bubble in the printing liquid (ink) one to one for reach of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quicker responses.

The driving signal in the form of pulses is preferably such as disclosed in the specifications of U.S. Pat. Nos. 4,463,359 and 4,345,262. In this respect, if the conditions disclosed in the specification of U.S. Pat. No. 4,313,124 regarding the rate of temperature increase of the heating surface is preferably are adopted, it is possible to perform an excellent printing in a better condition.

The structure of the printing head may be as shown in each of the above-mentioned specifications wherein the structure is arranged to combine the discharging ports, liquid passages, and electrothermal transducers as disclosed in the above-mentioned patents (linear type liquid passage or right angle liquid passage). Besides, it may be possible to form a structure such as disclosed in the specifications of U.S. Pat. Nos. 4,558,333 and 4,459,600 wherein the thermally activated portions are arranged in a curved area.

Furthermore, as a full line type printing head having a length corresponding to the maximum printing width, the present invention demonstrates the above-mentioned effect more efficiently with a structure arranged either by combining plural printing heads disclosed in the above-mentioned specifications or by a single printing head integrally constructed to cover such a length.

In addition, the present invention is effectively applicable to a replaceable chip type printing head which is connected electrically with the main apparatus and can be supplied with ink when it is mounted in the main assemble, or to a cartridge type printing head having an integral ink container.

Furthermore, as a printing mode for the printing apparatus, it is not only possible to arrange a monochromatic mode mainly with black, but also it may be possible to arrange an apparatus having at least one of multi-color mode with different color ink materials and/or a full-color mode using the mixture of the colors irrespective of the printing heads which are integrally formed as one unit or as a combination of plural printing heads. The present invention is extremely effective for such an apparatus as this.

Now, in the embodiments according to the present invention set forth above, while the ink has been described as liquid, it may be an ink material which is solidified below the room temperature but liquefied at the room temperature or may be liquid. Since the ink is controlled within the temperature not lower than 30° C. and not higher than 70° C. to stabilize its viscosity for the provision of the stable discharge in general, the ink may be such that it can be liquefied when the applicable printing signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being discharged as ink liquid by enabling itself to be liquefied anyway when the thermal energy is given in accordance with printing signals, an ink which will have already begun solidifying itself by the time it reaches a printing medium.

In addition, as modes of a printing apparatus according to the present invention, there are a copying apparatus combined with reader and the like, and those adopting a mode as a facsimile apparatus having transmitting and receiving functions, besides those used as an image output terminal structured integrally or individually for an information processing apparatus such as a word processor and a computer.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A printing apparatus using a printing head ejecting an ink for performing printing by ejecting the ink onto a printing medium, comprising:

a container for maintaining the ink to be supplied to the printing head;

detecting means for detecting a remaining amount condition of the ink in said container, wherein said detecting means detects whether an amount of ink in said container is less than or equal to a predetermined amount;

alarming means for generating an alarm when said detecting means detects that the remaining amount condition is that the amount of the ink is less than or equal to the predetermined amount; and control means for causing a printing operation with a predetermined amount of printing to be performed after generation of the alarm by said alarming means and for interrupting the printing operation when said detecting means does not detect that the remaining amount condition is that the amount of ink is not less than the predetermined amount.

2. A printing apparatus as claimed in claim 1, wherein said control means stops generation of the alarm by said alarming means and allows resumption of printing when said detecting means detects that the remaining amount condition is that the amount of the ink is not less than the predetermined amount.

3. A printing apparatus as claimed in claim 1, further comprising a capping means for covering a surface of the printing head opposite to the printing medium.

4. A printing apparatus as claimed in claim 1, which further comprises means for performing a recovery operation for stabilizing ejection of the ink from the printing head upon resumption of printing from a temporarily interrupted state.

5. A printing apparatus as claimed in claim 4, wherein said means for performing a recovery operation is ink pressurizing means for pressurizing ink within the printing head.

6. A printing apparatus as claimed in claim 1, wherein the printing medium is an elongated medium including rolled paper or cloth.

7. A printing apparatus as claimed in claim 6, wherein the printing head generates a bubble in the ink utilizing heat energy and ejects ink associating with generation of the bubble.

8. A printing apparatus as claimed in claim 1, further comprising temporary interruption means for interrupting printing operation temporarily, and wherein said control means makes said temporary interruption means temporarily interrupt the printing when said detecting means does not detect that the remaining amount condition is that the amount of the ink is not less then the predetermined amount while the printing operation with the predetermined amount of printing is performed.

9. A printing apparatus as claimed in claim 8, wherein said control means stops the alarm by said alarming means and resumes printing, when said detecting means detects that the ink amount condition is that the amount of the ink is not less than the predetermined amount while the printing operation is temporarily interrupted by said temporary interruption means.

10. A printing apparatus as claimed in claim 8, further comprising order means for ordering resumption of printing, and wherein said control means stops the alarm by said alarming means and resumes printing, when said detecting means detects that the ink amount condition is that the amount of the ink is not less than the predetermined amount when resumption of printing is ordered by said order means.

11. A printing apparatus as claimed in claim 8, which further comprises protection means for protecting a surface of the printing head opposite to the printing medium when printing is temporarily interrupted.

12. An ink-jet printing apparatus using a printing head for ejecting an ink and, a container maintaining the ink to be supplied to said printing head, and performing printing by ejecting ink toward a printing medium, said apparatus comprising:

detecting means for detecting a remaining amount condition of the ink in said container, wherein said detecting means detects whether an amount of ink in said container is less than or equal to a predetermined amount;

memory means for memorizing the remaining amount condition;

informing means for informing a user regarding the remaining amount condition;

interrupting means for interrupting printing temporarily; and control means for controlling said memory means, said informing means and said interrupting means, and for causing a printing operation with a predetermined amount of printing to be performed after said detecting means detects that the remaining amount condition is that the amount of ink is less than or equal to the predetermined amount, wherein said control means causes said memory means to memorize the remaining amount condition and causes said informing means to inform the user regarding the remaining amount condition when said detecting means detects that the remaining amount condition is that the amount of ink in said container is less than or equal to the predetermined amount, causes said memory means to memorize a remaining amount condition that the amount of ink in said container is not less than the predetermined amount when said detecting means detects that the remaining amount condition is that the amount of ink becomes not less than the predetermined amount while the printing operation with the predetermined amount of printing is performed, and causes the interrupting means to interrupt printing based on a content of said memory means.

13. An ink-jet printing apparatus as claimed in claim 12, which further comprises ordering means for ordering resumption of printing, and wherein said control means causes said informing means to stop informing and causes resumption of printing when said detecting means detects that the remaining amount condition is that the amount of ink is not less than the predetermined amount and said ordering means orders resumption of printing.

14. A printing apparatus as claimed in claim 12, wherein the printing head generates a bubble in the ink utilizing heat energy and ejects ink associating with generation of the bubble.

15. A printing method for performing printing by ejecting ink to a printing medium, comprising the steps of:

preparing a printing head for ejecting an ink and a container for storing ink to be supplied to said printing head;

detecting a remaining amount condition of the ink in said container, according to whether an amount of ink in said container is less than or equal to a predetermined amount;

generating an alarm when a remaining amount condition is detected in said detecting step that the amount of ink within said container is less than or equal to the predetermined amount;

performing a printing operation with a predetermined amount of printing, after said generating step; and controlling the printing, comprising interrupting the printing operation performed in said performing step when the remaining amount condition is not that the amount of ink is not less that the predetermined amount.

16. A printing method as claimed in claim 15, wherein said controlling step further comprises stopping generation of said alarm and allowing the printing to be continued, when the remaining amount condition is that the amount of ink is not less than the predetermined amount while the printing operation with the predetermined amount of printing is performed.

17. A printing method as claimed in claim 15, wherein said container is constructed to allow ink to be supplied thereto, further comprising a step of supplying the ink to said container, after generation of the alarm in said alarming step, while the printing operation with the predetermined amount of printing is performed, and wherein said controlling step further comprises stopping generation of the alarm and allowing the printing to be continued, when the remaining amount condition is that the amount of the ink is not less than the predetermined amount.

18. A printing method as claimed in claim 15, wherein said container is constructed to be exchanged, further comprising the step of exchanging the container, after generation of the alarm in said alarming step, while the printing operation with the predetermined amount of printing is performed, and wherein said detecting step further comprises detecting an exchange of the container and said controlling step further comprises stopping generation of the alarm and allowing printing to be continued, when the remaining amount condition detected in said detecting step is that the amount of the ink is not less than the predetermined amount in accordance with the exchange of the container.

19. A printing method as claimed in claim 15, wherein the printing head generates a bubble in the ink utilizing heat energy and ejects ink associating with generation of the bubble.

20. An ink-jet printing apparatus performing printing on a printing medium by ejecting an ink to the printing medium from an ink-jet head, said apparatus comprising:

a main tank for storing the ink;

a sub-ink tank for temporarily storing the ink supplied from said main tank and supplying the ink to the ink-jet head;

detecting means for detecting a condition as to whether an amount of ink in said main tank is less than or equal to a predetermined amount;

alarming means for generating an alarm; and control means for causing said alarming means to generate the alarm as well as allowing a printing operation to be performed with a predetermined amount of printing when said detecting means detects the condition that the amount of ink in said main tank is less than or equal to said predetermined amount, wherein said control means allows the printing operation to continue to be performed when said detecting means detects the condition that the amount of ink in said main tank is greater than said predetermined amount, and terminates the printing operation after the printing operation with said predetermined amount of printing is performed when said detecting means does not detect the condition that the amount of ink in said main tank is greater than said predetermined amount.

21. An ink-jet printing apparatus as claimed in claim 20, wherein said control means resumes the printing operation when a command by a user of said ink-jet printing apparatus is given after the printing operation is terminated by said control means.

22. An ink jet printing apparatus as claimed in claim 20, wherein said main tank is adapted to be supplied with the ink.

23. An ink-jet printing apparatus as claimed in claim 20, wherein said control means keeps said alarming means generating the alarm during performing the printing operation with said predetermined amount of printing.

24. An ink-jet printing apparatus as claimed in claim 20, further comprising a capping means for covering a surface of the printing head opposite to the printing medium.

25. An ink-jet printing apparatus as claimed in claim 20, which further comprises means for performing a recovery operation for stabilizing ejection of the ink from the printing head upon resumption of printing from a temporarily interrupted state.

26. An ink-jet printing apparatus as claimed in claim 25, wherein said means for performing a recovery operation is ink pressurizing means for pressurizing ink within the printing head.

27. An ink-jet printing apparatus as claimed in claim 20, wherein the printing medium is an elongated medium including rolled paper or cloth.

28. An ink-jet printing apparatus as claimed in claim 27, wherein the printing head generates a bubble in the ink utilizing heat energy and ejects ink associating with generation of the bubble.

29. An ink-jet printing method of performing printing on a printing medium by ejecting an ink to the printing medium from an ink-jet head, said method comprising the steps of:

preparing a main tank for storing the ink;

preparing a sub-ink tank for temporarily storing the ink supplied from said main tank and supplying the ink to the ink-jet head;

detecting a condition as to whether an amount of ink in said main tank is less than or equal to a predetermined amount;

preparing alarming means for generating an alarm; and controlling said alarming means to generate the alarm and a printing operation to be performed with a predetermined amount of printing when said detecting step detects the condition that the amount of ink in said main tank is less than or equal to said predetermined amount, wherein said controlling step allows the printing operation to continue to be performed when said detecting step detects the condition that the amount of ink in said main tank is greater than said predetermined amount, and terminates the printing operation after the printing operation with said predetermined amount of printing is performed when said detecting step does not detect the condition that the amount of ink in said main tank is greater than said predetermined amount.

30. An ink-jet printing apparatus as claimed in claim 29, wherein the printing head generates a bubble in the ink utilizing heat energy and ejects ink associating with generation of the bubble.

* * * * *